US010371392B2

(12) United States Patent
Na

(10) Patent No.: US 10,371,392 B2
(45) Date of Patent: Aug. 6, 2019

(54) COOKING APPLIANCE

(71) Applicant: LG ELECTRONICS INC., Seoul (KR)

(72) Inventor: Yiksoo Na, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 610 days.

(21) Appl. No.: 14/995,351

(22) Filed: Jan. 14, 2016

(65) Prior Publication Data

US 2016/0209051 A1 Jul. 21, 2016

(30) Foreign Application Priority Data

Jan. 16, 2015 (KR) ..... 10-2015-0007889

(51) Int. Cl.
*F24C 15/00* (2006.01)
*F24C 15/32* (2006.01)

(52) U.S. Cl.
CPC ..... *F24C 15/322* (2013.01); *F24C 15/006* (2013.01)

(58) Field of Classification Search
None
See application file for complete search history.

(56) References Cited

U.S. PATENT DOCUMENTS 2,526,890 A * 10/1950 Mendel ..... F24C 3/027 126/190
3,310,046 A * 3/1967 Scott ..... F24C 14/02 126/21 A
3,331,942 A * 7/1967 Scott ..... A47J 39/00 219/391

(Continued)

FOREIGN PATENT DOCUMENTS

CN 1108374 9/1995
CN 1301477 6/2001

(Continued)

OTHER PUBLICATIONS

Chinese Office Action dated Aug. 10, 2017 issued in Application No. 201610016425.0 (with English Translation).

(Continued)

*Primary Examiner* — Avinash A Savani
*Assistant Examiner* — Martha M Becton
(74) *Attorney, Agent, or Firm* — Ked & Associates LLP

(57) ABSTRACT

A cooking appliance is provided that may include a cabinet that defines an external appearance of the cooking appliance, a top plate provided at a top of the cabinet, the top plate being provided with a first cooking device that performs cooking using a heat source, and a second cooking device provided in the cabinet that performs cooking using a heat source. The cooking appliance may further include a control panel provided at a front of the cabinet, the control panel being provided therein with at least one air introduction hole, a controller provided at a rear of the control panel that controls the first cooking device and the second cooking device, and a heat dissipation fan provided between the control panel and a rear wall of the cabinet. A direction in which external air is introduced into the cooking appliance through the at least one air introduction hole and a direction in which the external air is discharged from the cooking appliance may be different from each other.

16 Claims, 8 Drawing Sheets

(56) References Cited

U.S. PATENT DOCUMENTS 3,698,378 A * 10/1972 Rosenberg ..... F24C 3/047 126/299 D
3,877,457 A * 4/1975 Doner ..... F24C 3/124 126/39 R
3,882,843 A * 5/1975 Barnett ..... F24C 14/02 126/21 A
3,889,100 A 6/1975 Dills
4,021,642 A * 5/1977 Fields, Jr. ..... F24C 15/2007 126/21 R
4,241,718 A * 12/1980 Barnett ..... F24C 15/006 126/19 R
4,375,213 A * 3/1983 Kemp ..... F24C 14/025 126/21 A
4,557,095 A * 12/1985 Rice ..... E06B 7/02 454/184
4,601,279 A 7/1986 Guerin
4,610,238 A * 9/1986 Veth ..... A21B 5/08 126/198
4,644,931 A * 2/1987 Veth ..... A21B 5/08 126/21 R
4,983,799 A * 1/1991 Bonnet ..... F24C 7/083 126/21 A
5,193,520 A * 3/1993 Gostelow ..... F24C 15/006 126/198
6,444,958 B1 * 9/2002 Campbell ..... F24C 15/101 126/21 R
6,772,752 B1 * 8/2004 Boyer ..... F24C 7/082 126/21 A
7,049,552 B2 * 5/2006 Arntz ..... F24C 15/101 126/15 R
7,950,383 B2 * 5/2011 Brant ..... F24C 15/10 126/1 R
8,477,491 B1 * 7/2013 Ross ..... H05K 7/20736 361/679.48
9,007,764 B2 * 4/2015 Fujii ..... H05K 7/20145 165/104.33
9,383,112 B2 * 7/2016 Kwon ..... F24C 15/101
2007/0131220 A1 * 6/2007 Kim ..... F24C 15/006 126/273 R
2008/0024982 A1 * 1/2008 Holland ..... H05K 7/20581 361/695
2009/0050130 A1 * 2/2009 Kim ..... F24C 15/006 126/21 A
2012/0024803 A1 * 2/2012 Replogle ..... H04Q 1/09 211/26
2013/0312731 A1 * 11/2013 Zehr ..... F24C 15/006 126/15 A
2015/0216075 A1 * 7/2015 Henkel ..... H05K 7/1465 361/692

FOREIGN PATENT DOCUMENTS

| | | |
|---|---|---|
| CN | 2807090 | 8/2006 |
| DE | 10 2007 005 718 | 8/2008 |
| EP | 0 833 108 | 4/1998 |
| EP | 1 457 740 | 9/2004 |
| FR | 2 726 633 | 5/1996 |
| GB | 2 256 921 | 12/1992 |
| JP | 2007-225241 | 9/2007 |
| JP | 2010-203690 | 9/2010 |
| KR | 10-2004-0021906 | 3/2004 |

OTHER PUBLICATIONS

Australian Office Action dated Jun. 29, 2016.
European Search Report dated Jul. 20, 2016.
Korean Notice of Allowance dated Aug. 29, 2016.

* cited by examiner

COOKING APPLIANCE

CROSS-REFERENCE TO RELATED APPLICATION(S)

This application claims priority to Korean Patent Application No. 10-2015-0007889, filed in Korea on Jan. 16, 2015, which is hereby incorporated by reference as if fully set forth herein.

BACKGROUND

1. Field

A cooking appliance is disclosed herein.

2. Background

In general, cooking appliances are appliances that cook food or other items using electricity or other kinds of energy, for example, gas, at home, for example. Among cooking appliances, there are gas stoves, gas ovens, and gas ovens/stoves, which use gas as a heat source. In addition, there are induction stoves, electric stoves having a radiant heater, and microwave ovens, which use electricity as a heat source. Further, there are combination type cooking appliances including induction stoves, which use electricity, and gas ovens, which use gas.

For example, a gas oven/stove may be configured such that a gas stove is provided as a first cooking unit or device, and a gas oven, as a second cooking unit or device, may be disposed or provided under the gas stove. For an electric oven/stove, an electric stove or an induction stove may be provided as a first cooking unit or device, and an electric oven, as a second cooking unit or device, may be disposed or provided under the electric stove or the induction stove.

A control panel, which allows a user to control at least one selected from the first cooking unit and the second cooking unit, may be provided at a front of the cooking appliance. In addition, a circuit board, for example, a controller, configured to control the first cooking unit and the second cooking unit according to a user's manipulation of the control panel, may be disposed or provided at a rear (or a rear surface) of the control panel.

Heat generated from at least one selected from the first cooking unit and the second cooking unit may increase a temperature of the circuit board. As a result of the increase in temperature of the circuit board, the circuit board may be damaged. Further, it may become impossible to control the first cooking unit and the second cooking unit due to such damage to the circuit board.

BRIEF DESCRIPTION OF THE DRAWINGS

Embodiments will be described in detail with reference to the following drawings in which like reference numerals refer to like elements, and wherein.

DETAILED DESCRIPTION

Figure 1:
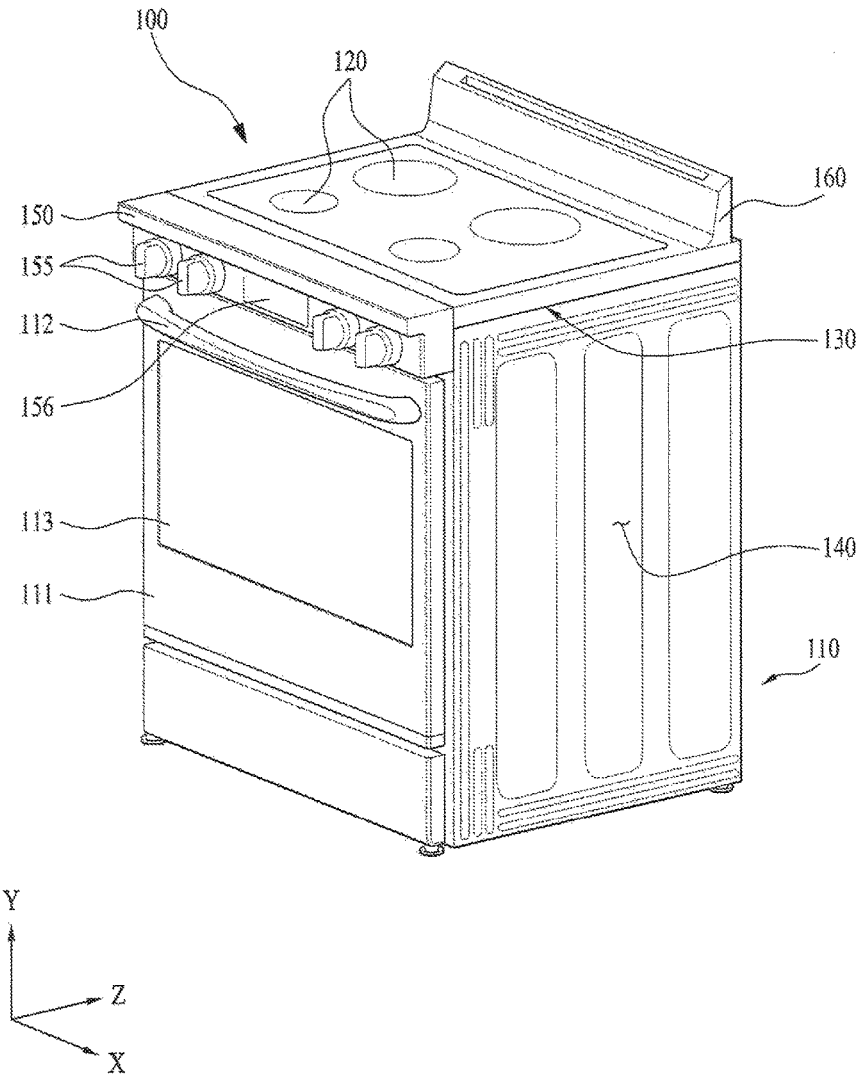
FIG. 1 is a perspective view of a cooking appliance according to an embodiment.

Reference will now be made in detail to embodiments, examples of which are illustrated in the accompanying drawings. It should be noted herein that the construction of an apparatus, which will hereinafter be described, and a method of controlling the apparatus are given only for illustrative purposes and a protection scope is not limited thereto. Wherever possible, the same or like reference numbers have been used throughout the drawings to refer to the same or like parts. In the drawings, sizes and shapes of elements may be exaggerated or reduced for convenience and clarity of description.

FIG. 1 is a perspective view of a cooking appliance according to an embodiment. Hereinafter, a cooking appliance that uses electricity as a heat source will be described by way of example for the sake of convenience. Alternatively, it is obvious that characteristics of embodiments are also applicable to a cooking appliance that uses gas as a heat source. Additionally, in FIG. 1, an X-axis direction will be defined as a widthwise direction, a Y-axis direction will be defined as a heightwise direction, and a Z-axis direction will be defined as a forward or rearward direction.

Referring to FIG. 1, a cooking appliance 100 according to an embodiment may include a cabinet 110 that defines an external appearance of the cooking appliance 100, a top plate 130 provided at a top of the cabinet 110, the top plate 130 being provided with a first cooking unit or device 120, a second cooking unit or device 140 provided in the cabinet 120, a control panel 150 coupled to a front of the top plate 130, and a door 111 provided at a front of the cabinet 110 to open and close the second cooking device 140.

A space to receive the second cooking device 140, in which cooking may be performed using a heat source, may be defined in the cabinet 110. The top plate 130 may be provided at the top of the cabinet 110. In addition, the first cooking device 120, on which cooking may be performed using a heat source, may be provided at or on the top plate 130.

Electricity or gas may be used for the heat sources of the first cooking device 120 and the second cooking device 140. For the sake of convenience, an example in which electricity is used for the heat sources of the first cooking device 120 and the second cooking device 140 will be described hereinafter.

For example, the first cooking device 120 may be provided with an induction heater or a radiant heater. In addition, the second cooking device 140 may be provided with an electric heater. A cooking device using electricity is generally known as an induction stove, an electric stove, or an electric oven, and therefore a detailed description thereof has been omitted.

The control panel 150 may be provided at the front of the cabinet 110. More specifically, the control panel 150 may be provided at a front of the top plate 130. The control panel 150 may be coupled to the top plate 130 at an upper side of the door 111, which may be provided at the front of the cabinet 110 so as to open and close the second cooking device 140. The door 111 may be provided with a transparent portion 113, through which an interior of the second cooking device 140 may be visible, and a handle 112 configured to open and close the door 111.

In addition, the control panel 150 may be provided with at least one manipulator 155 and a control command input 156. The manipulator 155 may have a rotatable knob shape. The control command input 156 may be a touch panel. In addition, the control command input 156 may display information, for example, a cooking course and cooking time, regarding cooking performed in the second cooking device 140. For example, a user may control the first cooking device 120 through the manipulator 155, and may control the second cooking device 140 through the control command input 156.

The cooking appliance 100 according to embodiments may further include a rear panel 160 provided at a rear of an upper side of the cabinet 110. The rear panel 160 may be integrally formed with the top plate 130. Alternatively, the rear panel 160 may be manufactured separately from the top plate 130, and may be provided at the rear of the upper side of the cabinet 110.

A controller C (see FIG. 2), configured to control the first cooking device 120 and the second cooking device 140, may be provided in a space inside of the control panel 150 or behind the control panel 150. The controller C may be a printed circuit board (PCB). The printed circuit board may be easily damaged due to heat.

That is, the controller C may be damaged due to heat generated from at least one selected from the first cooking device 120 or the second cooking device 140. In order to prevent an increase in temperature of the controller C, therefore, an air introduction hole and an air flow channel, which may be configured to supply external air to the controller C, may be provided.

At least one air introduction hole (see FIG. 3) may be formed in the control panel 150. Consequently, external air may be introduced into the control panel 150 through the at least one air introduction hole, which may be formed in the control panel 150, may pass through the controller C, and may be discharged from the cooking appliance 100 through an air discharge port formed in the rear panel 160.

Hereinafter, an air flow channel defined in the cooking appliance 100 will be described with reference to FIG. 2.

Figure 2:
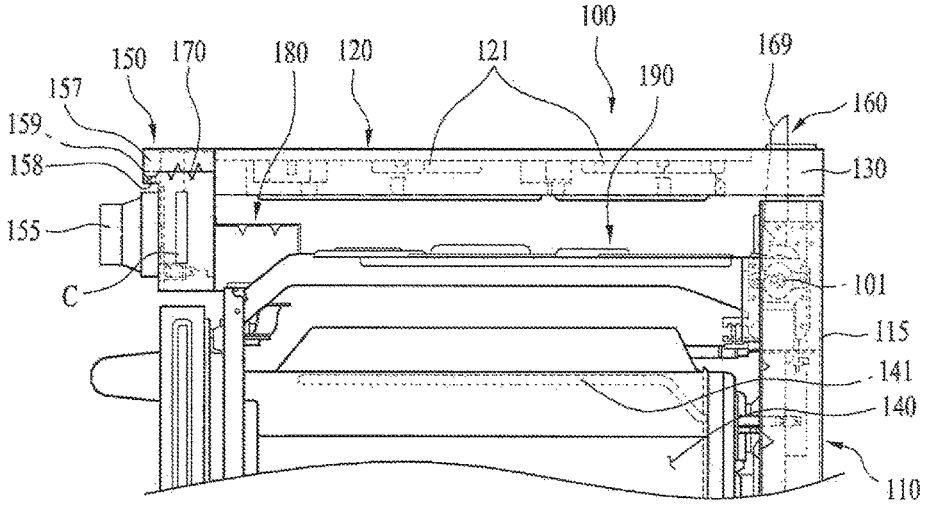
FIG. 2 is a partial view showing a portion (an upper portion) of the cooking appliance of FIG. 1.

FIG. 2 is a partial view of a portion (an upper portion) of the cooking appliance of FIG. 1. Referring to FIG. 2, the first cooking device 120 may be provided with at least one first heater 121, and the second cooking device 140 may be provided with at least one second heater 141. Heat generated from at least one selected from the first cooking device 120 or the second cooking device 140 as a result of an operation thereof may increase the temperature of the controller C, which will be described hereinafter.

Hereinafter, a structure capable of preventing the increase in temperature of the controller C will be described.

At least one air introduction hole 159 may be formed in the control panel 150. In addition, the cooking appliance 100 according to an embodiment may further include the controller C, provided at a rear of the control panel 150 that controls the first cooking device 120 and the second cooking device 140, and a heat dissipation fan 101, provided between the control panel 150 and a rear wall 115 of the cabinet 110.

The controller C may be provided closer to a front end of the cooking appliance 110 than to a rear end of the cooking appliance 110. That is, the controller C may be provided closer to a front wall of the cabinet 110 than to the rear wall 115 of the cabinet 110. In other words, the controller C may be provided closer to the door 111 than to the rear wall 115 of the cabinet 110.

The heat dissipation fan 101 may be provided closer to the rear wall 115 of the cabinet 110 than to the control panel 150. The heat dissipation fan 101 may be provided in the cabinet 110, such that the heat dissipation fan 101 is adjacent to the rear wall 115 of the cabinet 110.

Additionally, the heat dissipation fan 101 may be controlled by the controller C. For example, the controller C may control the heat dissipation fan 101 such that the heat dissipation fan 101 is driven when at least one selected from the first cooking device 120 or the second cooking device 140 is operated.

A direction in which external air is introduced into the cooking appliance 100, that is, into the control panel 150, through the at least one air introduction hole 159, which may be formed in the control panel 150, and a direction in which the external air is discharged from the cooking appliance 100 may be different from each other. That is, the direction in which external air is introduced into the cooking appliance 100 through the at least one air introduction hole 159 may be a rearward direction. Further, the direction in which the external air is discharged from the cooking appliance 100 may be an upward direction.

For example, as a result of the operation of the heat dissipation fan 101, external air may be introduced toward the rear of the cabinet 110 through the at least one air introduction hole 159, and the external air may be discharged to the rear of the cabinet 110 via the controller C. More specifically, air, introduced into the cooking appliance 110 through the at least one air introduction hole 159, may be discharged upward from the cabinet 110 at the rear end of the cabinet 110.

A portion, that is, the front of the cooking appliance 100, through which external air is introduced into the cooking appliance 100, and a portion, that is, the rear of the cooking appliance 100, through which the external air is discharged from the cooking appliance 100, may be sufficiently spaced apart from each other, thereby preventing interference between the air which is introduced and the air which is discharged.

The control panel 150 may be provided with a protrusion 157 configured to protrude toward the front of the cabinet 110, that is, toward the front of the cooking appliance 100. The at least one air introduction hole 159 may be formed in the protrusion 157. For example, the at least one air introduction hole 159 may be formed in a lower wall 158 of the protrusion 157. As a result, a structure capable of introducing external air into the control panel 150, that is, into the cooking appliance 100, without deteriorating the external appearance of the cooking appliance 100 may be provided. In addition, the lower wall 158 of the protrusion 157 and the manipulator 155 may be spaced apart from each other by a predetermined distance, such that external air may be easily introduced through the at least one air introduction hole 159.

A plurality of air introduction holes 159 may be provided in a widthwise direction of the control panel 150, which will be described hereinafter with reference to FIG. 3.

The cooking appliance 100 according to an embodiment may further include a first guide 170 provided in the control panel 150 that guides external air introduced through the at least one air introduction hole 159 to the rear of the cooking appliance 100. The controller C may be provided in front of the first guide 170 in the control panel 150. As a result, external air introduced through the at least one air introduction hole 159, formed in the control panel 150, may pass through the controller C while being guided to the rear of the cooking appliance 100 by the first guide 170.

The first guide 170 will be described hereinafter with reference to related drawings.

The cooking appliance 100 according to an embodiment may further include a duct 190 provided between the first cooking device 120 and the second cooking device 140. That is, the duct 190 may be provided between the first cooking device 120 and the second cooking device 140, which may be provided so as to be spaced apart from each other in a vertical or upward and downward directions.

The duct 190 may guide external air which has passed through the first guide 170 to the rear of the cooking appliance 100. That is, the duct 190 may guide external air, introduced into the cooking appliance 100 through the at least one air introduction hole 159, to the rear of the cooking appliance 100, that is, toward the rear of the cabinet 110. The duct 190 may include an upper plate 191, and a lower plate 192, which may be coupled to the upper plate 191. The duct 190 will be described hereinafter with reference to related drawings.

The cooking appliance 100 according to an embodiment may further include a second guide 180 provided on the duct 190 at a rear of the first guide 170. The second guide member 180 may guide the external air which has passed through the first guide 170 to an inside of the duct 190. The second guide member 180 will be described hereinafter with reference to related drawings.

The heat dissipation fan 101 may be provided at a rear end of the duct 190 in a longitudinal direction thereof. For example, the heat dissipation fan 101 may be provided between the upper plate 191 and the lower plate 192 at the rear end of the duct 190 in the longitudinal direction thereof.

The rear panel 160 may be provided at the rear end of the duct 190 in the longitudinal direction thereof, such that the rear panel 160 extends substantially perpendicular to a surface on which the cabinet 110 is installed. An air discharge port 169, which may communicate with an outside of the cooking appliance 100, may be formed in or at an upper end of the rear panel 160. As the result of the operation of the heat dissipation fan 101, therefore, external air may sequentially pass through the at least one air introduction hole 159, the controller C, the first guide 170, the second guide 180, the duct 190, and the rear panel 160, and may then be discharged from the cooking appliance 100. That is, external air may be forcibly introduced into the cooking appliance 100 by the operation of the heat dissipation fan 101. In a case in which external air is forcibly introduced into the cooking appliance 100 by the heat dissipation fan 101, heat may be dissipated from the controller C more effectively than in a case in which external air is introduced into the cooking appliance 100 by natural convection.

Hereinafter, the at least one air introduction hole 159, which may be formed in the control panel 150, will be described with reference to FIG. 3. FIG. 3 is a perspective view of a control panel of the cooking appliance of FIG. 1.

Figure 3:
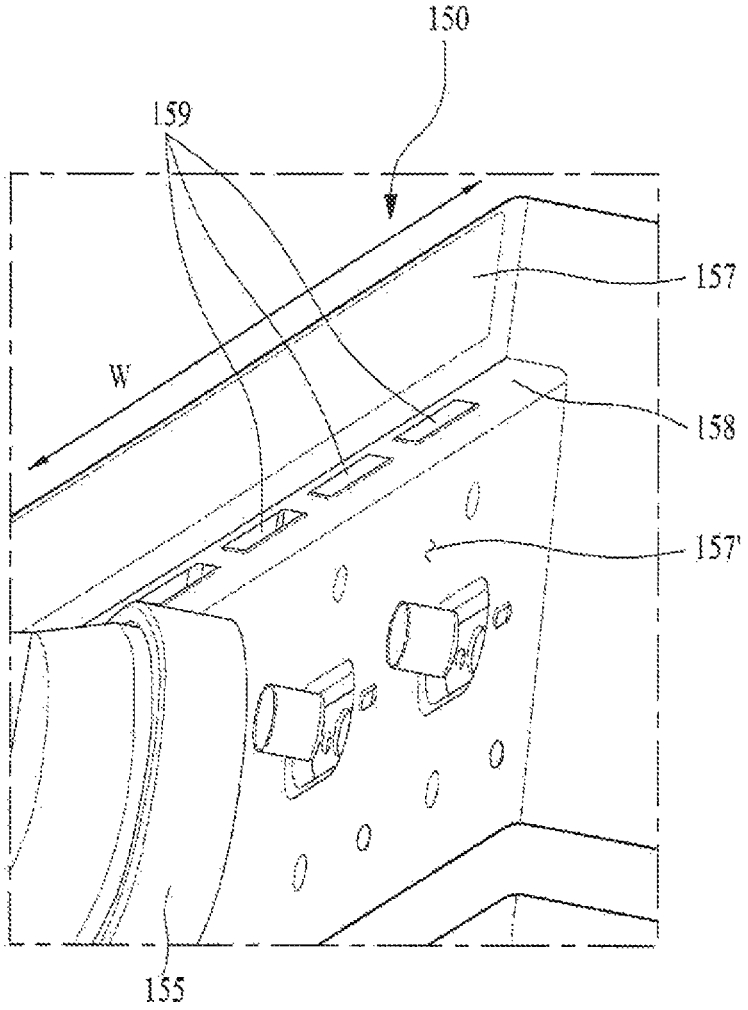
FIG. 3 is a perspective view of a control panel of the cooking appliance of FIG. 1.

Referring to FIG. 3 together with FIG. 2, the protrusion 157, which may protrude toward the front of the cabinet 110, may be provided at the control panel 150. That is, the control panel 150 may be provided at the front surface thereof with the protrusion 157 and a hollow portion 157'. The at least one air introduction hole 159 may be formed in or on the protrusion 157, and the manipulator 155 may be provided at the hollow portion 157'. More specifically, the at least one air introduction hole 159 may be formed in the lower wall 158 of the protrusion 157. As a result, a structure capable of introducing external air into the control panel 150, that is, into the cooking appliance 100, without deteriorating the external appearance of the cooking appliance 100 may be provided.

In addition, a plurality of air introduction holes 159 may be provided in a widthwise direction W of the control panel 150. More specifically, a plurality of air introduction holes 159 may be formed in the widthwise direction of the control panel 150, such that the plurality of air introduction holes 159 is arranged at predetermined intervals. As a result, an amount of external air introduced through the plurality of air introduction holes 159 may be increased, and a strength of the control panel 150 may be increased.

The lower wall 158 of the protrusion 157 and the manipulator 155 may be spaced apart from each other by a predetermined distance. More specifically, the lower wall 158 of the protrusion 157 and an upper end of the manipulator 155 may be spaced apart from each other. As a result, a flow of external air introduced through the plurality of air introduction holes 159 may be prevented from being interfered with or obstructed by the manipulator 155.

Figure 4:
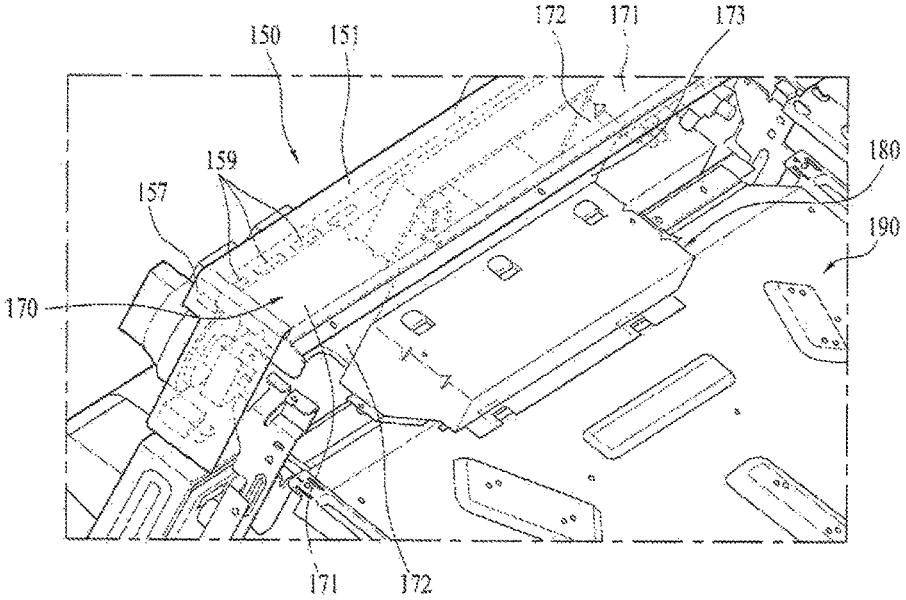
FIG. 4 is a view a first guide and a second guide provided at a rear of the control panel of the cooking appliance of FIG. 1.
Figure 5:
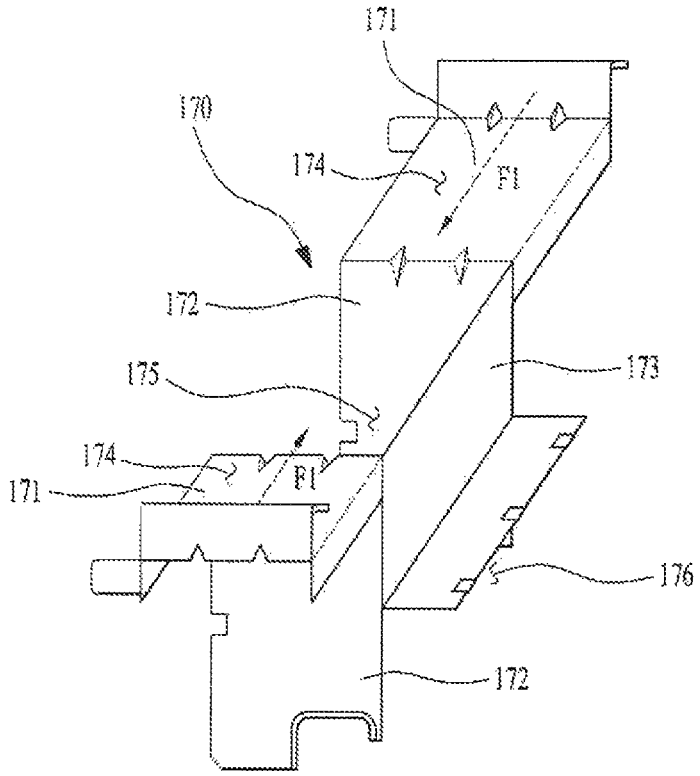
FIG. 5 is a perspective view of the first guide of FIG. 4.
Figure 6:
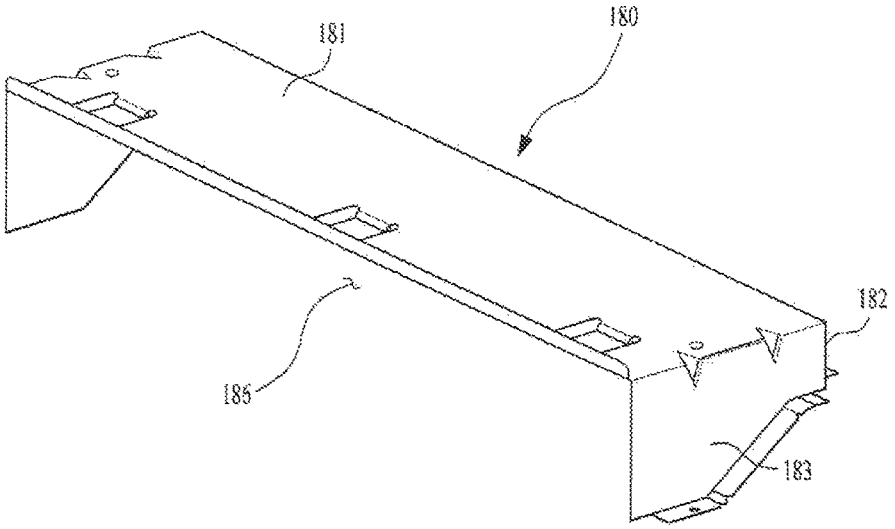
FIG. 6 is a perspective view of the second guide of FIG. 4.
Figure 7:
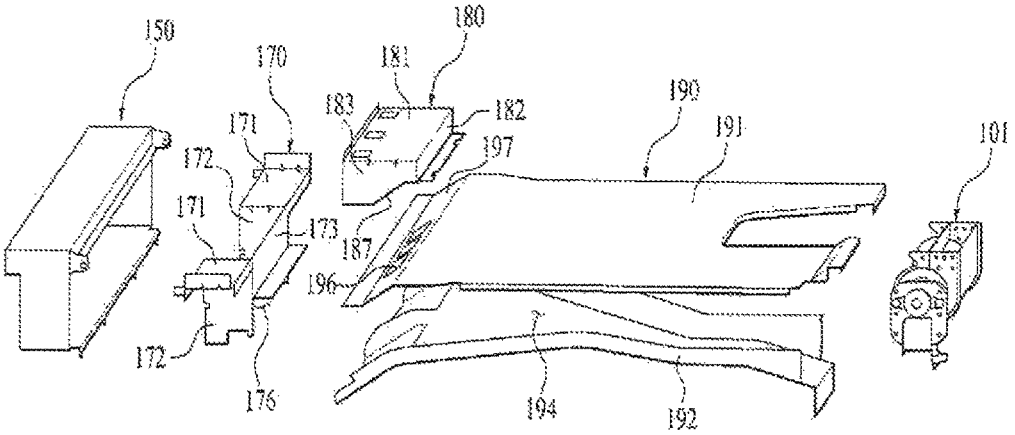
FIG. 7 is an exploded perspective view of the control panel, the first guide, the second guide, a duct, and a fan.

Hereinafter, the first guide and the second guide, which may be provided at the rear of the control panel 150, will be described with reference to related drawings. FIG. 4 is a partial view showing a first guide and a second guide, which may be provided behind the control panel of the cooking appliance of FIG. 1. FIG. 5 is a perspective view of the first guide of FIG. 4. FIG. 6 is a perspective view of the second guide of FIG. 4. FIG. 7 is an exploded perspective view of the control panel, the first guide member, the second guide, the duct, and the fan.

Referring first to FIG. 4, the cooking appliance 100 according to an embodiment may include the first guide 170 provided in the control panel 150 that guides external air introduced through the at least one air introduction hole 159 formed in the control panel 150. For example, the first guide 170 may guide external air, introduced through the at least one air introduction hole 159, to the rear of the cooking appliance 100.

In addition, the first guide 170 may be provided at a rear end of the control panel 150, or may be provided in the space inside of the control panel 150. In this embodiment, the first guide 170 is provided in the space inside of the control panel 150; however, embodiments are not limited thereto.

In addition, the controller C may be provided between the control panel 150 and the first guide 170 (see FIG. 2). More specifically, referring to FIG. 5 together with FIG. 4, the first guide 170 may include two horizontal portions 171, which may extend in a widthwise direction, two vertical portions 172, which may extend downward from respective facing ends of the two horizontal portions 171, and a blocking portion 173 provided between the two vertical portions 172 that cover at least a portion of the rear end of each of the two vertical portions 172. The two horizontal portions 171 may be spaced apart from each other by a predetermined distance, and may extend in a horizontal direction.

In addition, the two horizontal portions 171 may be provided at a lower side of an upper wall 151 of the control panel 150. For example, the two horizontal portions 171 may be provided at the lower side of the upper wall 151 of the control panel 150, such that the two horizontal portions 171 are spaced apart from the upper wall 151 of the control panel 150.

As a result, a first horizontal flow channel 174 may be defined between the two horizontal portions 171 and the upper wall 151 of the control panel 150. External air introduced through the at least one air introduction hole 159 formed in the control panel 150, may be guided to a middle portion of the first guide 170 in the widthwise direction thereof through the first horizontal flow channel 174. For example, the external air introduced through the at least one air introduction hole 159 may be guided to the middle portion of the first guide 170 in the widthwise direction thereof in a direction indicated by arrow F1 shown in FIG. 5.

The two vertical portions 172 may extend downward from respective facing ends of the two horizontal portions 171. The two vertical portions 172 may be spaced apart from each other by a predetermined distance. For example, the two vertical portions 172 may be spaced apart from each other by the predetermined distance between the facing ends of the two horizontal portions 171.

As a result, a first vertical flow channel 175 may be defined between the two vertical portions 172. For example, the first vertical flow channel 175 may extend downward from an inner end of the first horizontal flow channel 174. Consequently, external air introduced through the at least one air introduction hole 159 may be introduced into the first vertical flow channel 175 via the first horizontal flow channel 174. That is, external air introduced through the at least one air introduction hole 159 may be sequentially guided to the first horizontal flow channel 174 and the first vertical flow channel 175.

The controller C (see FIG. 2) may be provided in the first vertical flow channel 175. When external air flows through the first vertical flow channel 175, therefore, heat may be dissipated from the controller C as a result of heat exchange between the controller C and the external air.

In addition, the blocking portion 173 may be provided between the two vertical portions 172. The blocking portion 173 may cover at least a portion of a rear end of each of the two vertical portions 172. For example, the blocking portion 173 may be provided at sides of the two vertical portions 172 which may be far from the control panel 150. That is, the blocking portion 173 may be provided farther from the control panel 150 than the first vertical flow channel 175.

The blocking portion 173 may cover a portion, for example, an upper side of a rear end of each of the two vertical portions 172. As a result, a first opening 176 may be formed between the two vertical portions 172 at a lower side of the blocking portion 173. That is, the first guide 170 may be provided with the first opening 176 formed between the two vertical portions 172 at the lower side of the blocking portion 173. Consequently, external air introduced into the first vertical flow channel 175 may flow toward the rear of the cooking appliance 100 through the first opening 176. That is, external air introduced through the at least one air introduction hole 159 may sequentially pass through the first horizontal flow channel 174, the first vertical flow channel 175, and the first opening 176, and may then be guided to the rear of the cooking appliance 100, that is, the rear of the cabinet 110.

The cooking appliance 100 according to an embodiment may further include the duct 190 configured to continuously guide external air, guided through the first opening 176, to the rear of the cooking appliance 100. More specifically, referring to FIG. 7 together with FIG. 4, the duct 190 may guide external air, introduced into the cooking appliance 100 through the at least one air introduction hole 159, to the rear of the cooking appliance 100, that is, the rear of the cabinet 110.

The duct 190 may be provided at the rear of the first guide 170. More specifically, the duct 190 may include the upper plate 191 and the lower plate 192, which may be coupled to the upper plate 191.

A second horizontal flow channel 194 may be defined between the upper plate 191 and the lower plate 192. That is, the upper plate 191 and the lower plate 192 may be coupled to each other such that the second horizontal flow channel 194 may be defined between the upper plate 191 and the lower plate 192.

The second horizontal flow channel 194 may communicate with the first opening 176 formed in the first guide 170. Consequently, fluid which has passed through the first opening 176 may be guided to the rear of the cooking appliance 100 through the second horizontal flow channel 194.

That is, external air introduced through the at least one air introduction hole 159 may be guided to the rear of the cooking appliance 100 through the first guide 170, and may be continuously guided to the rear of the cooking appliance 100 through the duct 190, that is, through the second horizontal flow channel 194. In other words, a front end of the duct 190 in the longitudinal direction thereof may be formed so as to communicate with the first opening 176, which may be formed in the first guide 170.

The cooking appliance 100 according to an embodiment may further include the second guide 180 provided on the duct 190 at the rear of the first guide 170. The second guide 180 may guide external air which has passed through the first opening 176, which may be formed in the first guide 170, to the second horizontal flow channel 194.

More specifically, referring to FIG. 7 together with FIGS. 4 and 6, the second guide 180 may be provided at an upper side of the duct 190 at a rear end of the first guide 170. For example, the second guide 180 may be provided on the upper plate 191 of the duct 190. In other words, the second guide 180 may be provided on the front end of the duct 190, that is, on a front end of the upper plate 191.

The second guide 180 may guide external air which has passed through the first opening 176 only to the second horizontal flow channel 194. That is, the second guide 180 may function to prevent external air which has passed through the first opening 176 from flowing to portions of the cooking appliance 100 other than the second horizontal flow channel 194.

More specifically, the second guide 180 may include a horizontal blocking portion 181, a rear blocking portion 182 that extends downward from a rear end of the horizontal blocking portion 181, and side blocking portions 183 that extend downward from respective opposite sides of the horizontal blocking portion 181 in a widthwise direction thereof. In addition, a front end of the second guide 180 may be open. That is, the second guide 180 may be provided at the front end thereof with an opening 186. Consequently, air which has passed through the first guide 170 may be introduced into the second guide 180 through the opening 186 formed in the second guide 180.

The horizontal blocking portion 181 may prevent external air introduced into the second guide 180 through the first guide 170 from flowing to an upper side of the second guide 180. In addition, the rear blocking portion 182 may prevent external air introduced into the second guide 180 from flowing to a rear of the second guide 180. That is, the rear blocking portion 182 may prevent external air introduced through a front of the second guide 180 from flowing to the upper side of the duct 190 without being introduced into the duct 190. In other words, the rear blocking portion 182 may prevent external air from flowing to the rear of the cooking appliance 100 at the upper side of the duct 190. In addition, the side blocking portions 183 may prevent external air introduced into the second guide 180 from flowing to opposite sides of the second guide 180 in the widthwise direction thereof.

The duct 190 may be provided with a first incline 197, which may be inclined downward. For example, the first incline 197 may be provided at the front end of the duct 190.

More specifically, the first incline 197 may be provided at the upper plate 191 of the duct 190. That is, the first incline 197, which may be inclined downward, may be formed at the front end of the upper plate 191.

A second incline 187, which may correspond to the first incline 197, may be formed at each of the side blocking portions 183 of the second guide 180. In addition, at least one second opening 196 may be formed in the first incline 197 of the upper plate 191. Consequently, external air introduced between the second guide 180 and the first incline 197 through the first opening 176 may be introduced into the second horizontal flow channel 194, which may be defined in the duct 190, through the second opening 196.

As the second opening 196 is formed in the first incline 197, external air may be smoothly guided to the horizontal flow channel 194 through the second opening 196. The second opening 196 may be provided at an inside of each of the side blocking portions 183, which may be provided at the second guide 180, in the widthwise direction thereof. Consequently, external air introduced into the second guide 180 may be guided into the second horizontal flow channel 194 through the second opening 196 without flowing to the outside of the second guide 180 in the widthwise direction thereof.

The cooking appliance 100 according to an embodiment may further include the heat dissipation fan 101 provided at the rear end of the duct 190. More specifically, referring to FIG. 7 together with FIG. 2, the heat dissipation fan 101 may be provided between the upper plate 191 and the lower plate 192 of the duct 190 at the rear end of the duct 190.

The heat dissipation fan 101 may suction external air through the second horizontal flow channel 194, which may be defined in the duct 190. For example, the heat dissipation fan 101 may suction external air flowing in the second horizontal flow channel 194 and supply the suctioned air into the rear panel 160 shown in FIG. 2. That is, the rear end of the duct 190 in the longitudinal direction thereof may communicate with an interior of the rear panel 160.

As the result of the operation of the heat dissipation fan 101, external air may be introduced through the at least one air introduction hole 159 formed in the control panel 150. The external air may sequentially pass through the first guide 170, the second guide 180, and the duct 190, and may then be discharged from the cooking appliance 100 through the air discharge port 169, which may be formed in the rear panel 160. That is, the rear end of the duct 190 in the longitudinal direction thereof and the air discharge port 169, which may be formed in the rear panel 160, may communicate with each other via the heat dissipation fan 101.

In addition, the rear panel 160 may be provided at the rear end of the duct 190 such that the rear panel 160 may extend perpendicular to a surface on which the cabinet 110 is installed or provided, that is, a surface on which the cooking appliance 100 is installed or provided.

The heat dissipation fan 101 may be provided between the rear end of the duct 190 and a lower end of the rear panel 160. The heat dissipation fan 101 may draw external air flowing in the duct 190 and supply the drawn air toward the air discharge port 169, which may be formed in the upper end of the rear panel 160. As a result of the operation of the heat dissipation fan 101, external air may be forcibly suctioned from the front of the cooking appliance 100. In addition, the external air may be discharged from the cooking appliance 100 via the rear panel 160, which may be provided at the rear of the cooking appliance 100.

That is, a portion, through which external air may be introduced into the cooking appliance 100, may be located at the front end of the cooking appliance 100, and a portion, through which the external air may be discharged from the cooking appliance 100, may be located at the rear end of the cooking appliance 100. As a result, interference between air which is introduced into the cooking appliance 100 and air which is discharged from the cooking appliance 100 may be prevented, whereby heat may be efficiently dissipated from the controller C, which may be provided between the first guide 170 and the control panel 150.

Hereinafter, a flow of external air which is introduced into the cooking appliance 100 and is then discharged from the cooking appliance 100 will be described with reference to related drawings.

Figure 8:
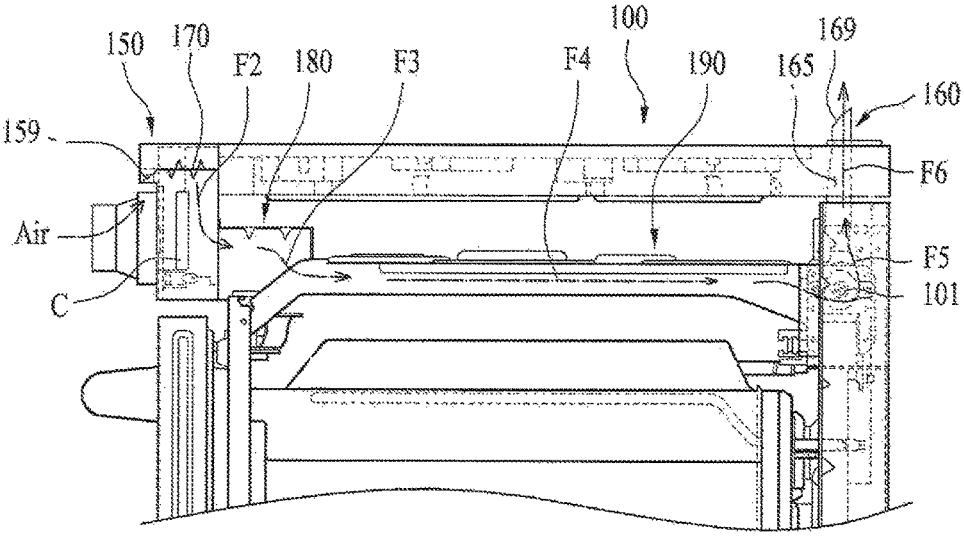
FIG. 8 is a partial view showing a flow of external air introduced into the cooking appliance of FIG. 2 and then discharged from the cooking appliance.

FIG. 8 is a partial view showing a flow of external air introduced into the cooking appliance of FIG. 2 and then discharged from the cooking appliance. First, external air may be introduced into the cooking appliance 100 as a result of the operation of the heat dissipation fan 101. That is, external air may be introduced into the control panel 150. As shown in FIGS. 2 and 3, external air may be introduced into the control panel 150 through the at least one air introduction hole 159, which may be formed in the control panel 150.

The external air, introduced into the control panel 150, may be guided through the first horizontal flow channel 174, which may be defined between the horizontal portions 171 of the first guide 170 and the upper wall 151 of the control panel 150 in the direction indicated by the arrow F1 shown in FIG. 5. The external air may be guided downward through the first vertical flow channel 175, which may communicate with the first horizontal flow channel 174. More specifically, the external air, guided along the first horizontal flow channel 174, may be guided along the first vertical flow channel 175 in a direction indicated by arrow F2 shown in FIG. 8.

Heat may be dissipated from the controller C, which may be provided in the first vertical flow channel 175, as the result of heat exchange between the external air and the controller C. The external air may be guided into the duct 190 through an interior of the second guide 180. That is, the external air may be guided in a direction indicated by arrow F3 shown in FIG. 8.

The second guide 180 may prevent the external air from flowing to spaces in the cooking appliance 100 other than an interior of the duct 190 when the external air is guided in the direction indicated by the arrow F3 shown in FIG. 8. In addition, the external air may be guided to the rear of the cooking appliance 100 through the second horizontal flow channel 194, which may be defined in the duct 190, in a direction indicated by an arrow F4 shown in FIG. 8.

Subsequently, the external air may be guided into the rear panel 160 by the heat dissipation fan 101, which may be provided at the rear end of the duct 190. That is, the flow of external air may be switched from the direction indicated by the arrow F4 to a direction indicated by an arrow F5 by the heat dissipation fan 101. That is, the heat dissipation fan 101 may switch the direction in which the external air flows in the duct 190 from the horizontal direction indicated by the arrow F4 to the vertical direction indicated by the arrow F5, such that the external air may flow into the rear panel 160.

A second vertical flow channel 165, which may extend in a vertical direction, may be defined in the rear panel 160.

Consequently, the external air may be guided upward through the second vertical flow channel 165 in a direction indicated by an arrow F6, and may then be discharged from the cooking appliance 100 through the air discharge port 169 formed in the upper end of the rear panel 160.

As described above, external air introduced through the at least one air introduction hole 159, which may be formed in the control panel 150, may sequentially pass through the first horizontal flow channel 174, the first vertical flow channel 175, the second horizontal flow channel 194, and the second vertical flow channel 165, and may then be discharged from the cooking appliance 100 through the air discharge port 169. That is, external air introduced through the at least one air introduction hole 159 may be guided to the middle portion of the first horizontal flow channel 174 in the widthwise direction thereof as indicated by the arrow F1 shown in FIG. 4, may be guided downward along the first vertical flow channel 175 as indicated by the arrow F2 shown in FIG. 8, may be guided to the rear of the cooking appliance 100 as indicated by the arrow F4, and may be discharged from the cooking appliance 100 as indicated by the arrow F6.

As is apparent from the above description, embodiments disclosed herein provide a cooking appliance capable of preventing an increase in temperature of a controller, that is, a circuit board, due to heat generated from or by a cooking device. In addition, embodiments disclosed herein provide a cooking appliance configured such that a direction in which external air is introduced into the cooking appliance and a direction in which the external air is discharged from the cooking appliance may be different from each other, whereby heat may be efficiently dissipated from a controller.

Further, embodiments disclosed herein provide a cooking appliance capable of preventing an increase in temperature of a controller, thereby preventing damage to the controller. Furthermore, embodiments disclosed herein provide a cooking appliance capable of effectively preventing an increase in temperature of a controller through operation of a fan.

Accordingly, embodiments disclosed herein are directed to a cooking appliance that substantially obviates one or more problems due to limitations and disadvantages of the related art.

Embodiments disclosed herein provide a cooking appliance capable of preventing an increase in temperature of a controller, that is, a circuit board, due to heat generated from a cooking unit.

Embodiments disclosed herein further provide a cooking appliance configured such that a direction in which external air is introduced into the cooking appliance and a direction in which the external air is discharged from the cooking appliance may be different from each other, whereby heat is efficiently dissipated from a controller. Embodiments disclosed herein provide a cooking appliance capable of preventing an increase in temperature of a controller, thereby preventing damage to the controller. Embodiments disclosed herein provide a cooking appliance capable of effectively preventing an increase in temperature of a controller by driving a fan.

Embodiments disclosed herein provide a cooking appliance that may include a cabinet that defines an external appearance of the cooking appliance, a top plate disposed or provided at a top of the cabinet, the top plate being provided with a first cooking unit or device that perform cooking using a heat source, and a second cooking unit or device provided in the cabinet that performs cooking using a heat source. The cooking appliance may further include a control panel disposed or provided at a front of the cabinet, the control panel being provided therein with at least one air introduction hole, a controller disposed or provided at a rear of the control panel that controls the first cooking unit and the second cooking unit, and a heat dissipation fan disposed or provided between the control panel and a rear wall of the cabinet. A direction in which external air is introduced into the cooking appliance through the at least one air introduction hole and a direction in which the external air is discharged from the cooking appliance may be different from each other.

As the result of the heat dissipation fan being driven, external air may be introduced toward the rear of the cabinet through the at least one air introduction hole, and the external air may be discharged to the rear of the cabinet via the controller. The control panel may be provided with a protruding part or protrusion configured to protrude toward the front of the cabinet, and the at least one air introduction hole may be formed in the protruding part. The at least one air introduction hole may be formed in a lower wall of the protruding part. The lower wall of the protruding part may be or may extend substantially parallel to a surface on which the cooking appliance may be installed or provided. The at least one air introduction hole may include a plurality of air introduction holes provided in a widthwise direction of the control panel.

The cooking appliance may further include a first guide member or guide disposed or provided in the control panel that guides external air introduced through the at least one air introduction hole to the rear of the cooking appliance. The controller may be disposed or provided in front of the first guide member in the control panel.

The first guide member may include two horizontal parts or portions that extend in a widthwise direction, two vertical parts or portions that extend downward from respective facing ends of the two horizontal parts, and a blocking part or portion disposed or provided between the two vertical parts that cover at least a portion of a rear end of each of the two vertical parts. The two horizontal parts may be disposed or provided at a lower side of the upper wall of the control panel, such that the two horizontal parts may be spaced apart from the upper wall of the control panel, whereby a first horizontal flow channel may be defined between the two horizontal parts and the upper wall of the control panel, a first vertical flow channel may be defined between the two vertical parts, the controller being disposed or provided in the first vertical flow channel, and the external air introduced through the at least one air introduction hole may be introduced into the first vertical flow channel via the first horizontal flow channel. The first guide member may be provided with a first opening, the first opening may be formed between the two vertical parts at a lower side of the blocking part, and the external air introduced into the first vertical flow channel may flow to the rear of the cooking appliance through the first opening.

The cooking appliance may further include a duct assembly or duct disposed or provided between the first cooking unit and the second cooking unit that guides the external air introduced into the cooking appliance through the at least one air introduction hole to the rear of the cabinet. The duct assembly may include an upper plate and a lower plate installed or provided on the upper plate, such that a second horizontal flow channel may be defined between the upper plate and the lower plate. The second horizontal flow channel may communicate with the first opening in the first guide member.

The cooking appliance may further include a second guide member or guide installed on the upper plate at the rear of the first guide member. The second guide member may be configured to guide external air having passed through the first opening in the first guide member to the second horizontal flow channel.

The second guide member may include a horizontal blocking part or portion, a rear blocking part or portion that extends downward from the rear end of the horizontal blocking part, and side blocking parts or portions that extend downward from opposite sides of the horizontal blocking part in a widthwise direction thereof. The upper plate may be provided at the front end thereof with a first inclined part or incline, the first inclined part being inclined downward, and each of the side blocking parts may be provided with a second inclined part or incline corresponding to the first inclined part. The first inclined part of the upper plate may be provided therein with at least one second opening, such that air introduced between the second guide member and the first inclined part may be introduced into the second horizontal flow channel through the at least one second opening. The heat dissipation fan may be installed or provided between the upper plate and the lower plate at the rear end of the duct assembly.

The cooking appliance may further include a rear panel installed or provided at the rear end of the duct assembly, such that the rear panel may be or extend substantially perpendicular to a surface on which the cabinet is installed or provided. The rear panel may be provided at the upper end thereof with an air discharge port that communicates with the outside.

The rear panel may have a second vertical flow channel defined therein, the second vertical flow channel may extend in a vertical direction, and external air introduced through the at least one air introduction hole may sequentially pass through the first horizontal flow channel, the first vertical flow channel, the second horizontal flow channel, and the second vertical flow channel, and may then be discharged from the cooking appliance through the air discharge port.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a cabinet that defines an external appearance of the cooking appliance;

a top plate provided at a top of the cabinet, wherein the top plate is provided with a first cooking device that performs cooking using a heat source, and a second cooking device provided in the cabinet that performs cooking using a heat source;

a control panel provided at a front of the cabinet, the control panel being provided therein with at least one air introduction hole;

a controller provided at a rear of the control panel that controls the first cooking device and the second cooking device;

a first guide provided in the control panel that guides external air introduced through the at least one air introduction hole to a rear of the cooking appliance;

a duct provided between the first cooking device and the second cooking device that guides the external air introduced into the cooking appliance through the at least one air introduction hole to a rear of the cabinet;

a second guide disposed between the first guide and the duct to guide the external air passing through the first guide to an inside of the duct; and a heat dissipation fan provided between the control panel and a rear wall of the cabinet, wherein a direction in which external air is introduced into the cooking appliance through the at least one air introduction hole is different from a direction in which the external air is discharged from the cooking appliance, wherein the controller is provided in front of the first guide in the control panel, wherein the first guide includes:

two horizontal portions that extend in a widthwise direction;

two vertical portions that extend downward from respective facing ends of the two horizontal portions; and a blocking portion provided between the two vertical portions that covers at least a portion of a rear end of each of the two vertical portions, wherein the controller is disposed between the two vertical portions, and wherein as a result of the heat dissipation fan being driven, external air is introduced toward the rear of the cabinet only through the at least one air introduction hole, and the external air is discharged to the rear of the cabinet after sequentially passing through the first guide, the controller, the second guide, and the duct.

2. The cooking appliance according to claim 1, wherein the control panel is provided with a protrusion that protrudes toward a front of the cabinet, and the at least one air introduction hole is formed in the protrusion.

3. The cooking appliance according to claim 2, wherein the at least one air introduction hole is formed in a lower wall of the protrusion.

4. The cooking appliance according to claim 3, wherein the lower wall of the protrusion extends substantially parallel to a surface on which the cooking appliance is provided.

5. The cooking appliance according to claim 3, wherein the at least one air introduction hole includes a plurality of air introduction holes provided in a widthwise direction of the control panel.

6. The cooking appliance according to claim 1, wherein the two horizontal portions are provided at a lower side of an upper wall of the control panel such that the two horizontal portions are spaced apart from the upper wall of the control panel, whereby a first horizontal flow channel is defined between the two horizontal portions and the upper wall of the control panel, a first vertical flow channel is defined between the two vertical portions, the controller being provided in the first vertical flow channel, and the external air introduced through the at least one air introduction hole is introduced into the first vertical flow channel via the first horizontal flow channel.

7. The cooking appliance according to claim 6, wherein the first guide is provided with a first opening, wherein the first opening is formed between the two vertical portions at a lower side of the blocking portion, and wherein the external air introduced into the first vertical flow channel flows to the rear of the cooking appliance through the first opening.

8. The cooking appliance according to claim 7, wherein the duct includes an upper plate, and a lower plate provided on the upper plate, such that a second horizontal flow channel is defined between the upper plate and the lower plate.

9. The cooking appliance according to claim 8, wherein the second horizontal flow channel communicates with the first opening in the first guide.

10. The cooking appliance according to claim 8, wherein the second is guide provided on the upper plate at a rear of the first guide, wherein the second guide is configured to guide external air having passed through the first opening in the first guide to the second horizontal flow channel.

11. The cooking appliance according to claim 10, wherein the second guide includes:

a horizontal blocking portion;

a rear blocking portion that extends downward from a rear end of the horizontal blocking portion; and side blocking portions that extend downward from opposite sides of the horizontal blocking portion in a widthwise direction thereof.

12. The cooking appliance according to claim 11, wherein the upper plate is provided at a front end thereof with a first incline, the first incline being inclined downward, and each of the side blocking portions is provided with a second incline corresponding to the first incline.

13. The cooking appliance according to claim 12, wherein the first incline of the upper plate is provided therein with at least one second opening, such that air introduced between the second guide and the first incline is introduced into the second horizontal flow channel through the at least one second opening.

14. The cooking appliance according to claim 8, wherein the heat dissipation fan is installed between the upper plate and the lower plate at a rear end of the duct.

15. The cooking appliance according to claim 8, further including:

a rear panel provided at a rear end of the duct such that the rear panel extends substantially perpendicular to a surface on which the cabinet is provided, wherein the rear panel is provided at an upper end thereof with an air discharge port that communicates with an outside of the cooking appliance.

16. The cooking appliance according to claim 15, wherein the rear panel has a second vertical flow channel defined therein, wherein the second vertical flow channel extends in a vertical direction, and wherein external air introduced through the at least one air introduction hole sequentially passes through the first horizontal flow channel, the first vertical flow channel, the second horizontal flow channel, and the second vertical flow channel, and is then discharged from the cooking appliance through the air discharge port.

* * * * *